US010960287B1

(12) United States Patent
Whitfield

(10) Patent No.: US 10,960,287 B1
(45) Date of Patent: Mar. 30, 2021

(54) PENDULUM STROKE TEACHING DEVICE

(71) Applicant: Richard A. Whitfield, Hobe Sound, FL (US)

(72) Inventor: Richard A. Whitfield, Hobe Sound, FL (US)

( * ) Notice: Subject to any disclaimer, the term of this patent is extended or adjusted under 35 U.S.C. 154(b) by 0 days.

(21) Appl. No.: 16/807,754

(22) Filed: Mar. 3, 2020

(51) Int. Cl.
*A63B 69/36* (2006.01)

(52) U.S. Cl.
CPC ..... *A63B 69/3685* (2013.01)

(58) Field of Classification Search
CPC ..... A63B 69/3685; A63B 69/3676; A63B 69/3679
See application file for complete search history.

(56) References Cited

U.S. PATENT DOCUMENTS 4,167,268 A * 9/1979 Lorang ..... A63B 69/3685 473/238
5,156,401 A * 10/1992 Hodgkiss ..... A63B 69/3632 473/227
5,482,247 A * 1/1996 Smith ..... A63B 69/3685 248/688
5,520,392 A * 5/1996 Foresi ..... A63B 69/0059 473/227
6,004,221 A * 12/1999 Thornhill ..... A63B 69/0059 473/227
6,471,598 B2 * 10/2002 Takase ..... A63B 69/0059 473/207
6,932,713 B1 * 8/2005 Kim ..... A63B 69/3608 473/227
7,544,135 B1 * 6/2009 Higgins ..... A63B 69/3676 473/219
8,496,537 B1 * 7/2013 Shao ..... A63B 69/0057 473/227
9,320,959 B1 * 4/2016 Awad ..... A63B 69/3685
2001/0021674 A1 * 9/2001 Takase ..... A63B 69/0059 473/212
2006/0035716 A1 * 2/2006 Brooks ..... A63B 69/0057 473/227
2012/0157219 A1 * 6/2012 Parlett ..... A63B 69/3685 473/226
2015/0314186 A1 * 11/2015 Gibson ..... A63B 69/3608 473/227
2016/0038819 A1 * 2/2016 Daniel ..... A63B 69/3685 473/238
2018/0028893 A1 * 2/2018 Herberth ..... A63B 69/3632

* cited by examiner

*Primary Examiner* — Raleigh W Chiu
(74) *Attorney, Agent, or Firm* — McHale & Slavin, P.A.

(57) ABSTRACT

A pendulum stroke teaching device formed from a one piece coupling element for use with conventional golf alignment sticks and an individual's putter club. The coupling element includes two spaced apart apertures for receipt of the distal ends of the alignment sticks. A centrally disposed cavity between the apertures is constructed and arranged for receipt of a putter shaft. The coupling element operates to secure the alignment sticks and putter in a fixed position. The ends of the alignment sticks are placed between the torso and the inner upper arms of the golfer. When the golfer grasps the putter grip, movement of the putter can only take place by use of a pendulum stroke. The teaching device is used for training the golfer to use a repetitive and consistent swing for improving their golf experience.

5 Claims, 2 Drawing Sheets

PENDULUM STROKE TEACHING DEVICE

FIELD OF THE INVENTION

This invention relates to the game of golf, and more particularly, to an apparatus for teaching a pendulum stroke putting technique.

BACKGROUND OF THE INVENTION

The game of golf is a well known recreational sport wherein individual players progress a ball along a golf course using a variety of golf clubs that each have a loft capable of moving a properly struck golf ball a predetermined distance. The golf course consists of eighteen separate holes, basically consisting of a tee and green section separated by a fairway. Typically, stroke play is used in scorekeeping, wherein the individual with the lowest number of strokes used to advance a golf ball over the eighteen holes is declared the winner. Unique to the game of golf is the fact that a golf ball moved two inches is considered one stroke; conversely, a golf ball driven 360 yards is considered one stroke.

No matter what type of golf match is played, eventually the ball must reach the green portion and be putted into a golf ball hole so as to complete the stroke tally. For instance, a par-five hole has a tee and green section separated by a fairway that can be over 500 yards long with obstacles such as water, sand, and trees that a golfer must navigate. A par-three hole may consist of a tee and green separated by as little as 100 yards, again with obstacles placed therebetween.

A green may be small or large, but in either event, putting on a green is considered easier than driving a golf ball. However, putting a golf ball requires a unique form of training to develop the proper skill. A golfer who takes two or three attempts to place the golf ball in the cup will never excel in the game of golf unless and until the golfer reduces their score by mastering the art of putting. The art of putting requires the golfer to understand the curves of the green formed by uneven surfaces.

Thus, putting a golf ball is just as important as driving a long ball. Ironically, putting is where most golfers have the greatest difficulty. The lack of proper training will not only cost the golfer additional strokes, but unless the golfer learns how to strike a ball consistently, the golfer will not be able to score well consistently.

To properly train an individual at golf, practice requires repetitive motions to develop muscle memory training. While an instructor can provide great insight into various golf techniques, an instructor cannot physically hold the club in a position required for proper muscle memory training.

Golf Alignment Sticks are well known training aids. Consisting of two fiberglass or plastic rods, commonly referred to as sticks, the sticks are an inexpensive but very effective training aid. The alignment stick is used to correct an individual's alignment by providing a visual aid to align the body and club face. The sticks can be easily stored within a golf bag, as the diameter of the sticks is negligible. In the defined use, alignment sticks are placed on the ground. One alignment stick is used to form a line toward a target location, and a second alignment stick is placed just outside the golfer's toe-line to provide a visual pathway. Both sticks are parallel to each other. The visual aid provides immediate feedback to the golfer that they are aligning their body and club head in the proper direction.

While putting is not as physically challenging as driving a long ball, technically it requires a repeatable swing to assure the putter clubface is aligned with the desired path the golf ball is to travel. A common improper putting technique is when the golfer uses their wrists or turns their body during the act of striking the ball. If the golfer is not properly rotating their arms, the golfer will cause a steering effect and result in a pushed or pulled putt.

Thus, while there are various devices to assist an individual in the proper putting technique, there is continued need for devices capable of improving an individual's golf score. Applicant's invention employs the use of the alignment sticks in a new and unexpected manner.

SUMMARY OF THE INVENTION

Disclosed is a putting aid device that attaches to a pair of golf alignment sticks and secures to the golfer's putter. In operation, the device allows the golf alignment sticks to be held in V-shaped configuration by placing a portion of the alignment stick over the forearms of the golfer with a distal end secured beneath the arms. The configuration forces the golfer's shoulders to be held in a fixed configuration, wherein an attached golf club can only be rotated using a pendulum swing. The device allows the use of conventional golf alignment sticks, allowing for compact storage.

In particular, the putting aid device employs a one-piece flexible grommet that attaches to golf alignment sticks and a golf putter club. The grommet includes two spaced apart apertures for receipt of the distal ends of the alignment sticks. A centrally disposed receptacle between the apertures is constructed and arranged for receipt of a golf putter shaft. With the alignment sticks and putter club in position, the alignment sticks are positioned between the arms and torso of a golfer as they grasp the grip handle on the putter club. In order for the golfer to make a swing motion, the golfer must rotate their shoulders to hold the alignment sticks in position, which requires the arms to stay in a fixed position relative to the torso; the result is the golfer can only strike the golf ball by a pendulum swing.

An objective of the invention is to provide a device for use in teaching a pendulum putting stroke to provide a golfer with a tactile feel of a pendulum stroke that is uniform in pace and path.

Another objective of the invention is to provide a pendulum stroke teaching device to develop a consistent and repeatable motion of the golfer's shoulders and arms.

Still another objective of the invention is to provide a pendulum stroke teaching device wherein the radius of the golfer's stroke remains constant throughout the pendulum swing.

Yet another objective of the invention is to provide a pendulum stroke teaching device that inhibits a golfer's use of their wrists to prevent hitting the golf ball with a wrist flip.

Still another objective of the invention is to provide a pendulum stroke teaching device that places the putter head in a consistent position during the process of putting.

Another objective of the invention is to repurpose the use of golf alignment sticks, providing a low cost device that can be used with another teaching device.

Still another objective of the invention is to provide a pendulum stroke teaching device that can be used with alignment sticks of various diameters.

Yet still another objective of the invention is to provide a pendulum stroke teaching device for use with conventional golf alignment sticks that is compact and does not consume much more storage space than a conventional golf ball.

Still another objective of the invention is to provide an instructional putting device that allows an individual to repeat an exact movement, so as to allow muscle memory by repetitive putting in a pre-determined aligned direction.

Other objectives and advantages of this invention will become apparent from the following description taken in conjunction with the accompanying drawings wherein are set forth, by way of illustration and example, certain embodiments of this invention. The drawings constitute a part of this specification, include exemplary embodiments of the present invention, and illustrate various objects and features thereof.

DETAILED DESCRIPTION OF THE PREFERRED EMBODIMENT

Figure 1:
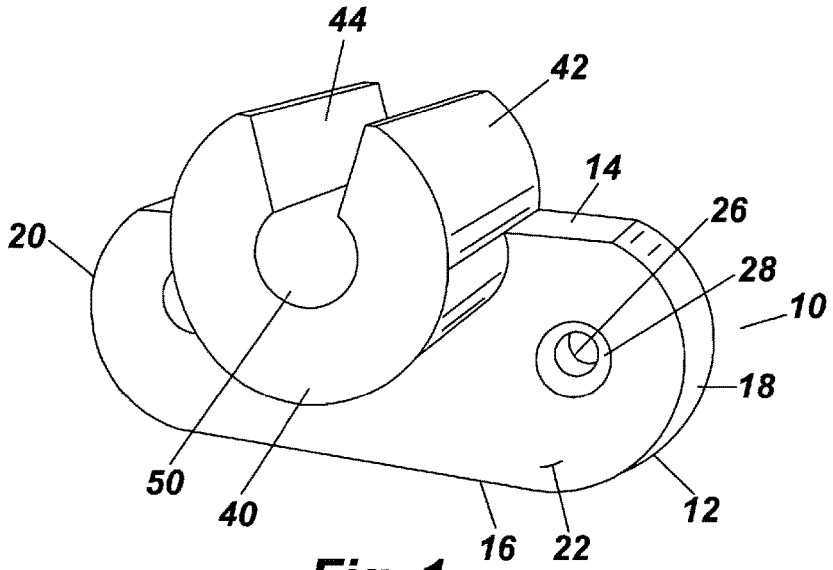
FIG. 1 is a perspective view of the pendulum stroke teaching device of the instant invention.
Figure 3:
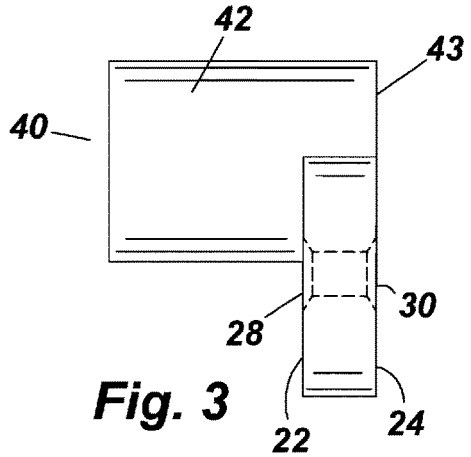
FIG. 3 is a side view thereof.
Figure 2:
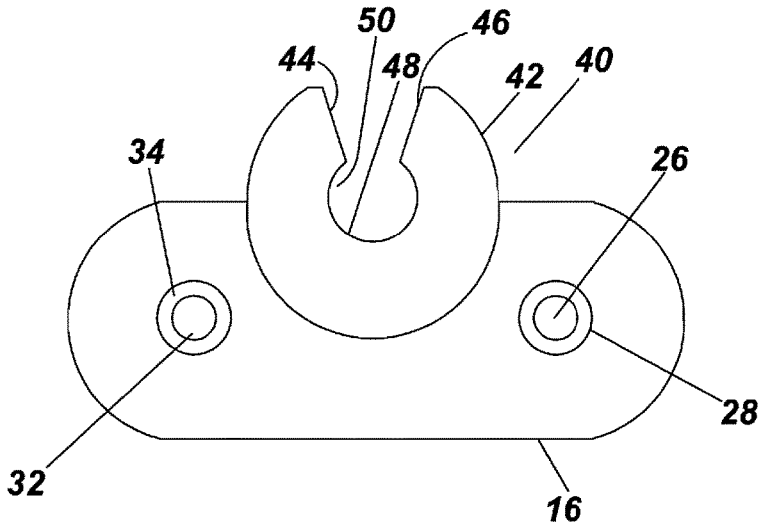
FIG. 2 is a front view thereof.
Figure 4:
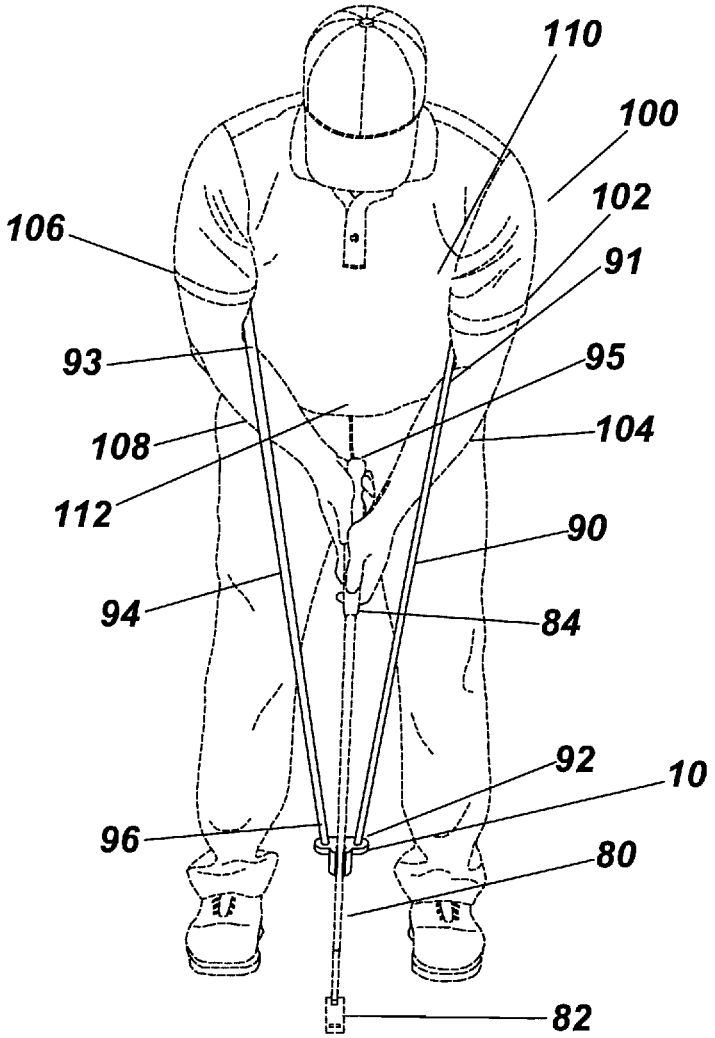
FIG. 4 is a pictorial view.

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

A pendulum-style stroke is when the golfer's hands, arms and shoulders rotate as a single unit. The golfer performs such a stroke by pulling a putter head back and swinging it through for striking a golf ball using one harmonious motion. A pendulum stroke finds the butt of the putter grip pointing at precisely the same spot from set-up to completion. A common training technique is to have the butt of the putter grip point towards the golfer's belly button during the entire stroke to assure a pendulum stroke is obtained.

Referring to the figures in general, disclosed is a pendulum stroke teaching device which is formed from a coupling element 10 comprising a one piece base 12 that is releasably secured to a golf putter 80 and conventional alignment sticks 90, 94. The base 12 is oblong shaped and includes two spaced apart apertures 26, 32 for receipt of the distal ends 92, 96 of the alignment sticks. A centrally disposed receptacle 50 located between the apertures 26, 32 is constructed and arranged for receipt of a putter shaft.

The coupling element 10 constructed of rubber and defined by an upper surface 14, a lower surface 16, a first side edge 18 between the upper and lower surface, and a second side edge 20 between the upper and lower surfaces. The base 12 has a front surface 22 and a back surface 24. A first through-hole aperture 26 extends between the front surface 22 and the back surface 24. A front chamfered edge 28 is formed along the front surface 22 leading to the aperture 26 and a rear chamfered edge 30 formed along the back surface 24 extends to the aperture 26. A second through-hole aperture 32 extends between the front surface 22 and the back surface 24. A front chamfered edge 34 is formed along the front surface 22 leading to the aperture and a rear chamfered edge, not shown, forms a mirror image of the first through-hole aperture 26.

A putter shaft receptacle 40 is centrally positioned between the first 26 and the second 32 aperture. The putter shaft receptacle 40 has a substantially circular shaped outer surface 42 with insert side walls 44 and 46 leading to an inner receptacle wall 48 defining a receptacle 50. The putter shaft receptacle 50 has a width between a first surface 40 and a second surface 43 which is sufficient in distance to hold a putter shaft in a fixed position with minimal flexibility between the receptacle 50 and the base 12.

The first and second through-hole apertures 26, 32 of the base 12 are constructed and arranged to receive the distal end of conventional alignment sticks, with the receptacle sized to capture a putter shaft. The alignment sticks and the putter shaft are coupled together and used to form the pendulum stroke training device. The width of the base 12 having a front surface 22 and a rear surface 24 is less than the receptacle width 50 allowing flexibility.

In operation, a first alignment stick 90 is coupled to the coupling element 10 by insertion of a first proximal end 92 into aperture 26, a chamfered edge 30 facilitating ease of insertion. A second alignment stick 94 is coupled to the coupling element 10 by insertion of a second proximal end 96 into the second aperture 32, a chamfered edge leading to the aperture facilitating ease of insertion. The shaft 80 of a putter 82 is placed into the receptacle 50, the biasing of the receptacle side walls 44, 46 holding the putter shaft 80 in position. With the golfer 100 grasping the hand grip 84 on the putter 82, a first proximal end 91 of the first alignment stick 90 is placed under the left arm 102 of the golfer with a portion of the alignment stick placed over the left forearm 104. A second proximal end 93 of the second alignment stick 94 is placed under the right arm 106 of the golfer 100 with a portion of the alignment stick 94 placed over the right forearm 108, wherein the alignment sticks 90, 92 form a V-shape with the proximal ends 91, 93 held in position between the inner arm and the torso 110 of the golfer. With the alignment sticks 90, 94 in position, the butt 95 of the putter grip is pointed toward the golfer's belly button 112. In order for the golfer to make a swing motion, the golfer must rotate the shoulders with the alignment sticks, causing the arms and wrist to stay fixed. The putter can only follow a pendulum swing when the alignment rods are secured beneath the golfer's arms.

In the preferred embodiment, the receptacle 50 is wider than the base 12. The receptacle 50 has minimal flexibility due to the width, while the base 12 has greater flexibility due to the width. The receptacle 50 holds the putter shaft in position while the base can flex, allowing the alignment sticks to be placed in a V-shape position. It should be noted that the coupling element can be placed in multiple positions to accommodate the individual golfer. The coupling element 10 can have the receptacle 50 accessible from above, with the width of the receptacle extending either toward or away from the golfer. Conversely, the coupling element 10 can have the receptacle 50 accessible from below with the width of the receptacle 50 extending either toward or away from the golfer.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A pendulum stroke teaching device used in combination with a putter and two alignment sticks, said device comprising:

a coupling element (10) formed from an oblong shaped base (12) constructed from a flexible material, said base (12) defined by an upper surface (14), a lower surface (16), a first side edge (18) between said upper and lower surfaces, and a second side edge (20) between said upper and lower surfaces, said base (12) having a front surface (22) and a back surface (24); said coupling element having a first through-hole aperture (26) extending between said front surface (22) and said back surface (24) spaced apart from a second through-hole aperture (32) extending between said front surface (22) and said back surface (24); said coupling element having a putter shaft receptacle (40) offset and centrally positioned between said first aperture (26) and said second aperture (32), said putter shaft receptacle (40) having a circular shaped receptacle 50 accessible by walls (44, 46);

wherein said first and second through-hole apertures (26,32) of said base (12) are constructed and arranged to receive distal ends of said alignment sticks with said receptacle (50) having said insert wall for receipt of a putter shaft, whereby said flexible base permits said alignment sticks (90,94) to be placed in a V-shaped position in respect to said putter shaft (80) for use as a pendulum stroke training device.

2. The pendulum stroke teaching device according to claim 1 including a chamfered edge leading to each said aperture.

3. The pendulum stroke teaching device according to claim 1 wherein said base and said receptacle are constructed from a single piece of material.

4. The pendulum stroke teaching device according to claim 3 wherein said flexible material is rubber.

5. The pendulum stroke teaching device according to claim 3 wherein said receptacle is wider than said base.

* * * * *